US009091264B2

(12) United States Patent
Hohl et al.

(10) Patent No.: US 9,091,264 B2
(45) Date of Patent: Jul. 28, 2015

(54) APPARATUS AND METHODS UTILIZING PROGRESSIVE CAVITY MOTORS AND PUMPS WITH ROTORS AND/OR STATORS WITH HYBRID LINERS

(75) Inventors: Carsten Hohl, Hannover (DE); Harald Grimmer, Niedersachsen (DE); Volker Krueger, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 624 days.

(21) Appl. No.: 13/306,673

(22) Filed: Nov. 29, 2011

(65) Prior Publication Data

US 2013/0133950 A1 May 30, 2013

(51) Int. Cl.

| | |
|---|---|
| ***E21B 4/02*** | (2006.01) |
| ***F04C 2/107*** | (2006.01) |
| ***E21B 43/12*** | (2006.01) |
| ***F03C 2/08*** | (2006.01) |
| ***F04C 13/00*** | (2006.01) |

(52) U.S. Cl.
CPC ..... *F04C 2/1075* (2013.01); *E21B 4/02* (2013.01); *E21B 43/128* (2013.01); *F03C 2/08* (2013.01); *F04C 13/008* (2013.01)

(58) Field of Classification Search
CPC ..... E21B 4/02
USPC ..... 175/107, 323; 418/48; 415/902
See application file for complete search history.

(56) References Cited

U.S. PATENT DOCUMENTS

| | | | | |
|---|---|---|---|---|
| 4,379,493 | A * | 4/1983 | Thibodeaux | 175/61 |
| 5,171,138 | A | 12/1992 | Forrest | |
| 5,395,221 | A | 3/1995 | Tucker, Jr. et al. | |
| 5,498,142 | A | 3/1996 | Mills | |
| 7,517,202 | B2 | 4/2009 | Delpassand | |
| 7,828,533 | B2 | 11/2010 | Podmore | |
| 2004/0258548 | A1 | 12/2004 | Zitka et al. | |
| 2005/0150689 | A1 | 7/2005 | Jogi et al. | |
| 2006/0182644 | A1 | 8/2006 | Delpassand et al. | |
| 2009/0016893 | A1 | 1/2009 | Lee et al. | |
| 2009/0152009 | A1 | 6/2009 | Slay et al. | |
| 2010/0038142 | A1 | 2/2010 | Snyder et al. | |
| 2011/0058930 | A1 | 3/2011 | Belcher | |

OTHER PUBLICATIONS

International Search Report and Written Opinion dated Apr. 29, 2013 for International Application No. PCT/US2012/064602.

* cited by examiner

*Primary Examiner* — Cathleen Hutchins
(74) *Attorney, Agent, or Firm* — Cantor Colburn LLP

(57) ABSTRACT

An apparatus for use downhole is disclosed that in one embodiment may include a rotor having an outer lobed surface disposed in a stator having an inner lobed surface, wherein the inner lobed-surface or the outer-lobed surface includes a sealing material on a first section thereof and a metallic surface on a second section thereof.

22 Claims, 5 Drawing Sheets

APPARATUS AND METHODS UTILIZING PROGRESSIVE CAVITY MOTORS AND PUMPS WITH ROTORS AND/OR STATORS WITH HYBRID LINERS

BACKGROUND

1. Field of the Disclosure

This disclosure relates generally to apparatus for use in wellbore operations utilizing progressive cavity power devices.

2. Background of the Art

To obtain hydrocarbons, such as oil and gas, boreholes or wellbores are drilled by rotating a drill bit attached to a drill string end. A large proportion of the current drilling activity involves drilling deviated and horizontal boreholes to increase the hydrocarbon production and/or to withdraw additional hydrocarbons from the earth's formations. Current drilling systems utilized for drilling such wellbores generally employ a drill string having a drill bit at its bottom that is rotated by a motor (commonly referred to as a "mud motor" or a "drilling motor"). A typical mud motor includes a power section that includes a rotor having an outer lobed surface disposed inside a stator having an inner lobed surface. Such a device forms progressive cavities between the rotor and stator lobed surface. Such motors are commonly referred to as progressive cavity motors or Moineau motors. Also, certain pumps used in the oil industry utilize progressive cavity power sections. The stator typically includes a metal housing lined inside with a helically contoured or lobed elastomeric material. The rotor typically includes helically contoured lobes made from a metal, such as steel. Pressurized drilling fluid (commonly known as the "mud" or "drilling fluid") is pumped into progressive cavities formed between the rotor and stator lobes. The force of the pressurized fluid pumped into the cavities causes the rotor to turn in a planetary-type motion.

The disclosure herein provides progressive cavity motors and pumps wherein a section of the rotor or stator is made from or lined with an elastomeric to provide sufficient seal between the rotor and stator and one or more sections of both the rotor and motor are made from or lined with a metallic material to reduce the load on the elastomeric material.

SUMMARY OF THE DISCLOSURE

In one aspect, a drilling apparatus is disclosed that in one configuration may include a stator having an inner lobed-surface, a rotor having an outer lobed-surface disposed in the stator, wherein at least one of the inner lobed-surface and the outer-lobed surface includes a sealing material on a first section thereof and a metallic surface on a second section thereof.

In another aspect, a method of drilling a wellbore is disclosed that in one embodiment may include: deploying a drill string in the wellbore that includes a drilling motor coupled to a drill bit at an end of the drill string, wherein the drilling motor includes a stator having an inner lobed-surface, a rotor having an outer lobed-surface and disposed in the stator, wherein at least one of the inner lobed-surface and the outer-lobed surface includes a sealing material on a first section thereof and a metallic surface on a second section thereof; and supplying a fluid under pressure to the drilling motor to rotate the rotor and the drill bit to drill the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
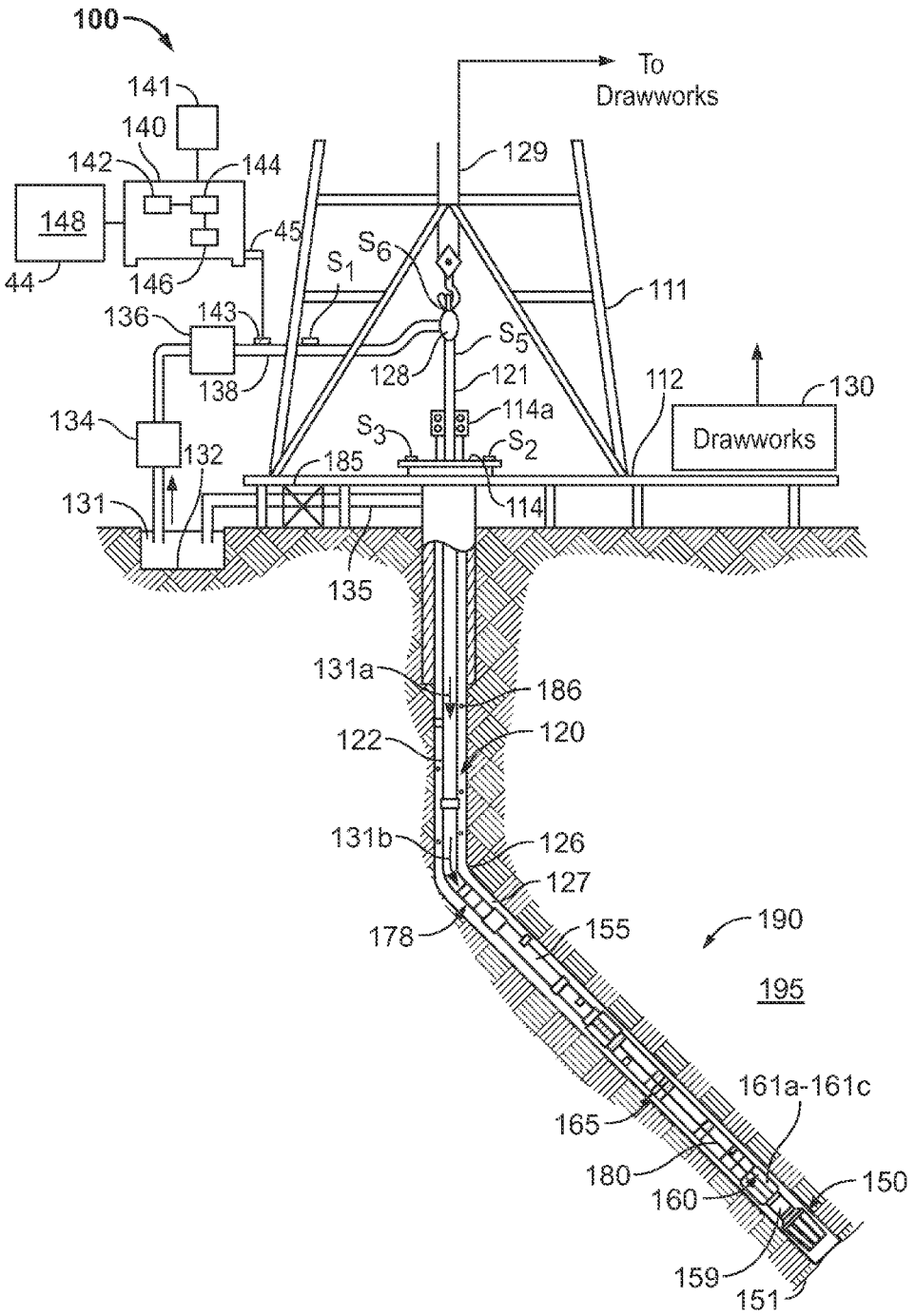
FIG. 1 is an elevation view of a drilling system that includes a device for determining direction of the drill string during drilling of the wellbore.

FIG. 1 is a schematic diagram of an exemplary drilling system 100 that includes a drill string 120 having a drilling assembly or a bottomhole assembly 190 attached to its bottom end. Drill string 120 is conveyed in a borehole 126. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

In one aspect, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided by a program to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations of the downhole and surface devices.

The drilling assembly 190 may also contain formation evaluation sensors or devices (also referred to as measurement-while-drilling ("MWD") sensors or logging-while-drilling ("LWD") sensors) for determining various properties of interest, such as resistivity, density, porosity, permeability, acoustic properties, nuclear-magnetic resonance properties of the formation, corrosive properties of the fluids, salt or saline content in the fluids, and other selected properties of the formation 195. Such sensors are generally known in the art and for convenience are collectively denoted herein by numeral 165. The drilling assembly 190 may further include a variety of other sensors and communication devices 159 for controlling and/or determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 1, the drill string 120 further includes power generation device 178. In an aspect, the energy conversion device 178 is located in the BHA 190 to provide an electrical power to sensors 165, communication devices 159 and other tools or devices in the BHA 190. The drilling assembly 190 further includes a steering device 160 that in one embodiment may include steering members (also referred to a force application members) 160*a*, 160*b* and 160*c* configured to independently apply force on the borehole 126 to steer the drill bit 150 along any particular direction.

Figure 2:
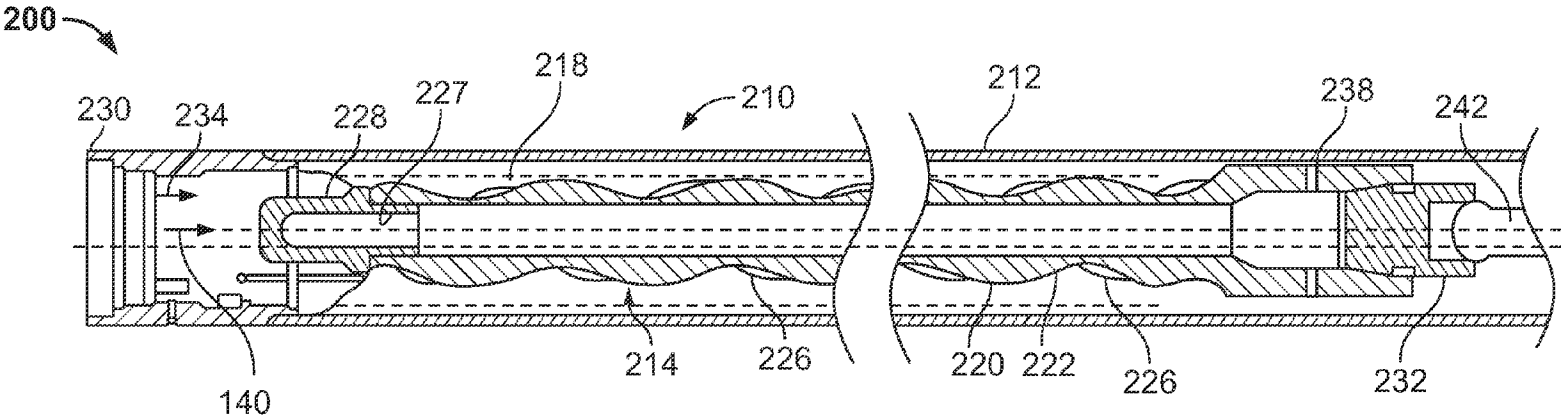
FIG. 2 shows a drilling motor including a hybrid rotor and/or stator, according to one embodiment of the disclosure.
Figure 2:
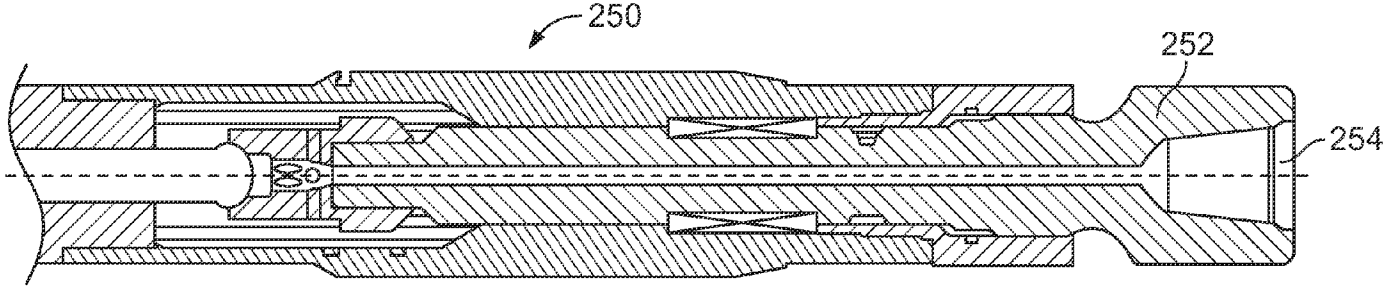

FIG. 2 shows a cross-section of an exemplary drilling motor 200 that includes a rotor made according to one embodiment of the disclosure. The drilling motor 200 includes a power section 210 and a bearing assembly 250. The power section 210 contains an elongated metal housing 212 having therein a stator 214 that includes lobes 218. The stator 214 is secured inside the housing 212 or formed integral with the housing 212. A rotor 220, containing lobes 222 is rotatably disposed inside the stator 214. The stator 214 includes one lobe more than the number of rotor lobes. In aspects, the rotor 220 may have a bore 224 that terminates at a location 227 below the upper end 228 of the rotor 220 as shown in FIG. 2. The bore 224 remains in fluid communication with the drilling mud 240 below the rotor 220 via a port 238. The rotor lobes 222 and the stator lobes 218 and their helical angles are such that the rotor 220 and the stator 214 seal at discrete intervals, resulting in the creation of axial fluid chambers or cavities 226 that are filled by the pressurized drilling fluid or mud 240 when such fluid is supplied to the motor 200 from the surface during drilling of a wellbore. The pressurized drilling fluid 240 flowing from the top 230 of the motor 200 to the bottom 252 of the power section 210, as shown by arrow 234, causes the rotor 220 to rotate within the stator 214. The design and number of the lobes 218 and 222 define the output characteristics of the motor 200. In one configuration, the rotor 220 is coupled to a flexible shaft 242 that connects to a rotatable drive shaft 252 in the bearing assembly 250 that carries a drill bit (not shown) in a suitable bit box 254. During a drilling operation, the pressurized fluid 240 rotates the rotor 220 that in turn rotates the flexible shaft 242. The flexible shaft 242 rotates the drill shaft 252, which in turn rotates the bit box 254 and thus the drill bit. When fluid 240 is supplied under pressure to the motor 200, the rotor 220 rotates in the stator 214. In the present disclosure at least one section of the rotor and/or stator includes an elastomeric material and one or more other sections are made of metallic or non-elastomeric materials. It is known that that the elastomeric material on one of the stator or rotor lobed-surface provides a durable seal between the rotor and stator lobes. It also is known that the elastomeric material is subjected to high mechanical load during operation of the motor. In the mud motors made according to various embodiments of this disclosure, either the rotor or the stator includes at least one section that has an elastomeric or non-metallic surface and at least one other section has a metallic surface. In such configurations, a portion of the load on the elastomeric material is shifted over to the metallic sections, without compromising the seal between the rotor and stator lobes. Certain exemplary hybrid configurations of the stator and rotor are described in reference to FIGS. 3-8.

Figure 3:
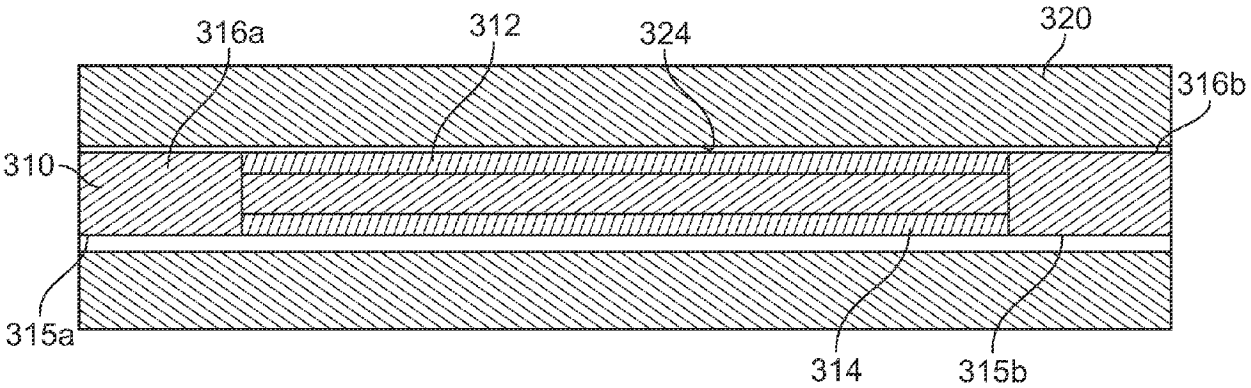
FIG. 3 shows an outline of a rotor disposed in a stator wherein the outer surface of a middle section of the rotor comprises a sealing material and the outer surfaces of the outer sections comprise a metallic material.

FIG. 3 shows a line diagram of an exemplary rotor 310 disposed in a stator 320, wherein the outer surface of a middle section 312 of the rotor 310 is lined with an elastomeric material 314, such a rubber or another suitable non-metallic material. In this configuration, the outer surfaces 315*a* and 315*b* of the two end sections 316*a* and 316*b* respectively of the rotor 310 are made or lined with a metallic material. Also, the entire inner surface 324 of the stator 320 is made of or lined with a metallic material. The interference fit between the elastomeric material 314 in section 312 and the stator inside surface 324 is positive and provides a seal between the rotor 310 and stator 320. The end sections 316*a* and 316*b* made from a metallic material take up some of the load away from the elastomeric material 312 on the rotor section 312.

Figure 4:
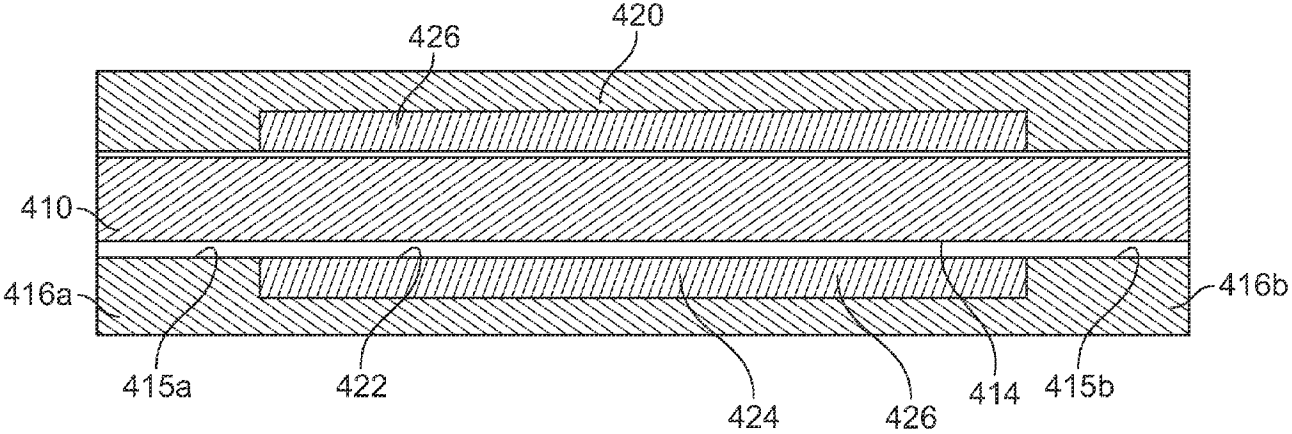
FIG. 4 shows an outline of a rotor disposed in a stator wherein a middle section of the stator comprises a sealing material and the outer sections comprise a metallic material.

FIG. 4 shows a line diagram of an exemplary rotor 410 disposed in a stator 420, wherein the inner surface 422 of a middle section 424 of the stator 420 is lined with an elastomeric material 426, such as rubber or another suitable non-metallic material. In this configuration, the inner surfaces 415*a* and 415*b* of the two end sections 416*a* and 416*b* respectively of the stator 420 are made of or lined with a metallic material. Also, the entire outer surface 414 of the rotor 410 is made of or lined with a metallic material. The interference fit between the elastomeric material 426 in section 424 and the rotor outer surface 414 is positive and provides a seal between the rotor 410 and stator 420. The interference clearance between the metallic surfaces of the rotor and stator is zero or negative.

Figure 5:
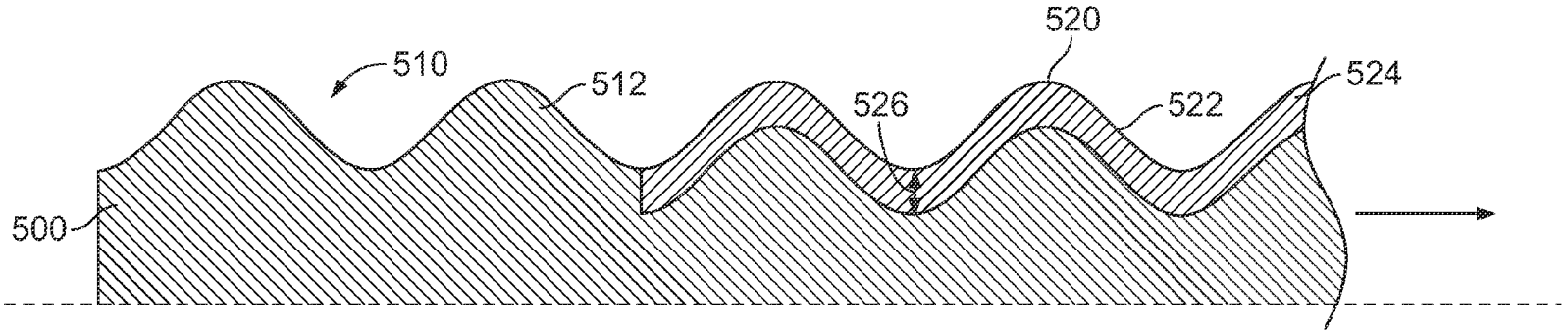
FIG. 5 shows a rotor whose middle section includes a uniform layer of a sealing material.

FIG. 5-8 show various exemplary thickness layers for the elastomeric material in the middle section of the stator and/or rotor. FIG. 5 shows an end section 510 and a partial middle section 520 of a rotor 500. The outer lobed surface 512 of the end section 510 is made of or lined with a metallic material. The outer lobed-surface 522 of the middle lobed section 520 of the rotor is lined with an elastomeric material 524 of uniform thickness 526. As clearly shown in FIG. 5, in certain emobidments, the elastomeric material 524 is at least partially embedded in the metallic material of the rotor 500. Thus, in certain emobidments, the thickness of the metallic material embedded with the elastomeric material 524 of the middle section 520 differs from the metallic material of the end section 510.

Figure 6:
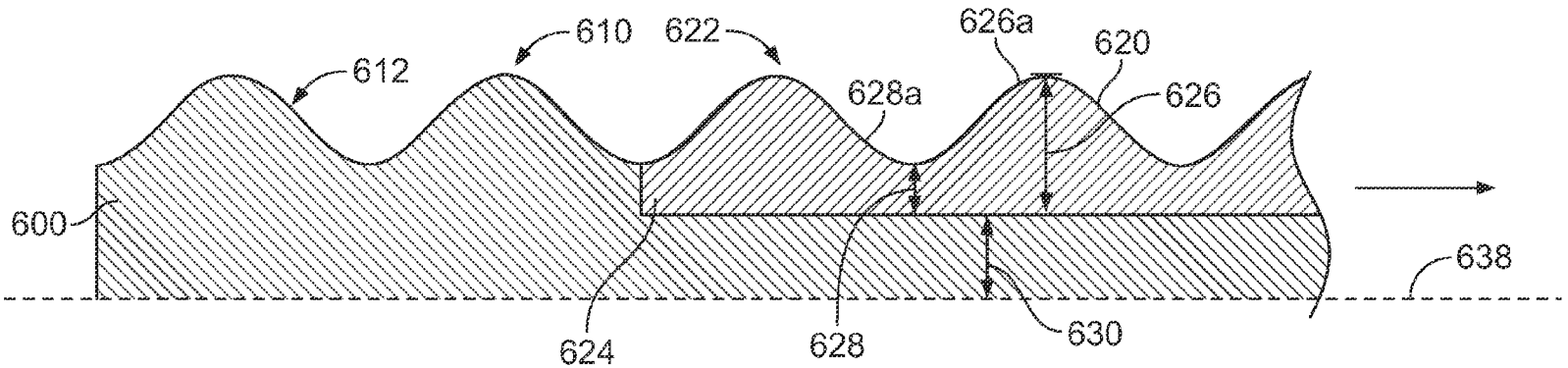
FIG. 6 shows a rotor whose middle section includes a non-uniform layer of a sealing material.

FIG. 6 shows an end section 610 and a partial middle section 620 of a rotor 600. The outer lobed surface 612 of the end section 610 is made of or lined with a metallic material. The outer lobes 622 of the middle lobed-section 620 of the rotor 600 is made of or lined with an elastomeric material 624. The elastomeric material thickness is uneven. For example, the thickness 626 of the ridge 626*a* is greater than the thickness 628 of the valley 628*a*. The depth 630 of the rotor metallic material from the rotor centerline 638 to the elastomeric material 624 is shown to be constant, but may differ along the length of the middle section. As clearly shown in FIG. 6, in certain embodiments, the elastomeric material 624 is at least partially embedded in the metallic material of the rotor 600. Thus, in certain embodiments, the thickness of the metallic material embedded with the elastomeric material 624 of the middle section 620 differs from the metallic material of the end section 610.

Figure 7:
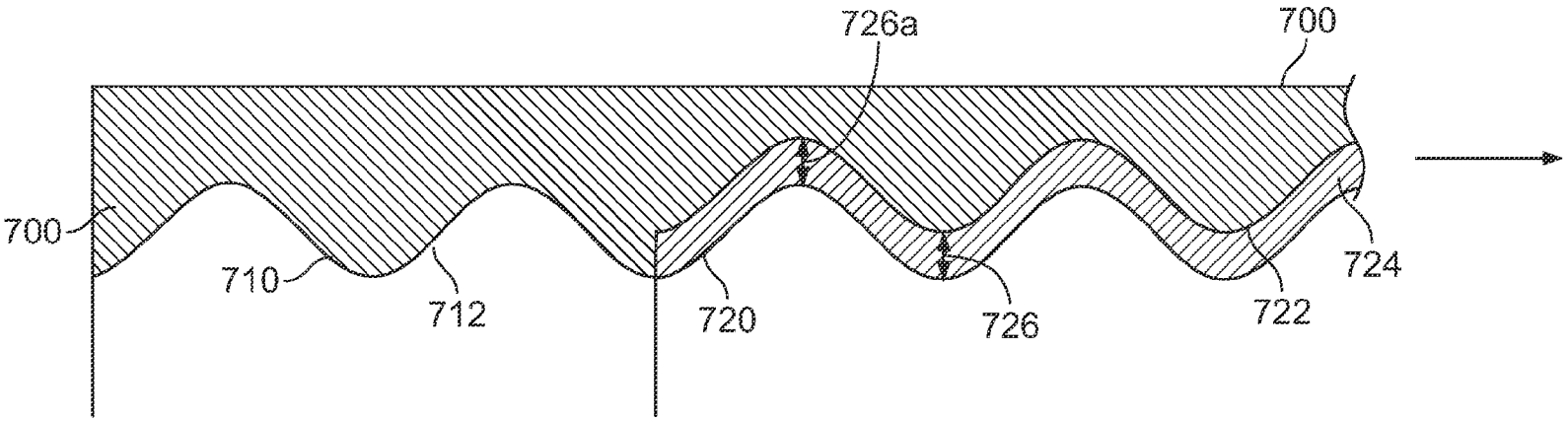
FIG. 7 shows a stator whose middle section includes a uniform layer of a sealing material.

FIG. 7 shows an end section 710 and a partial middle section 720 of a stator 700. The inner lobed-surface 712 of the end section 710 is made of or lined with a metallic material. The inner lobed-surface 722 of the middle lobed-section 720 of the stator is lined with an elastomeric material 724 of uniform or substantially uniform thickness 726. As clearly shown in FIG. 7, in certain emobidments, the elasomeric material 724 is at least partially embedded in the metallic material of the stator 700. Thus, in certain embodiments, the thickness of the metallic material embedded with the elastomeric material 724 of the middle section 720 differs from the metallic material of the end section 710.

Figure 8:
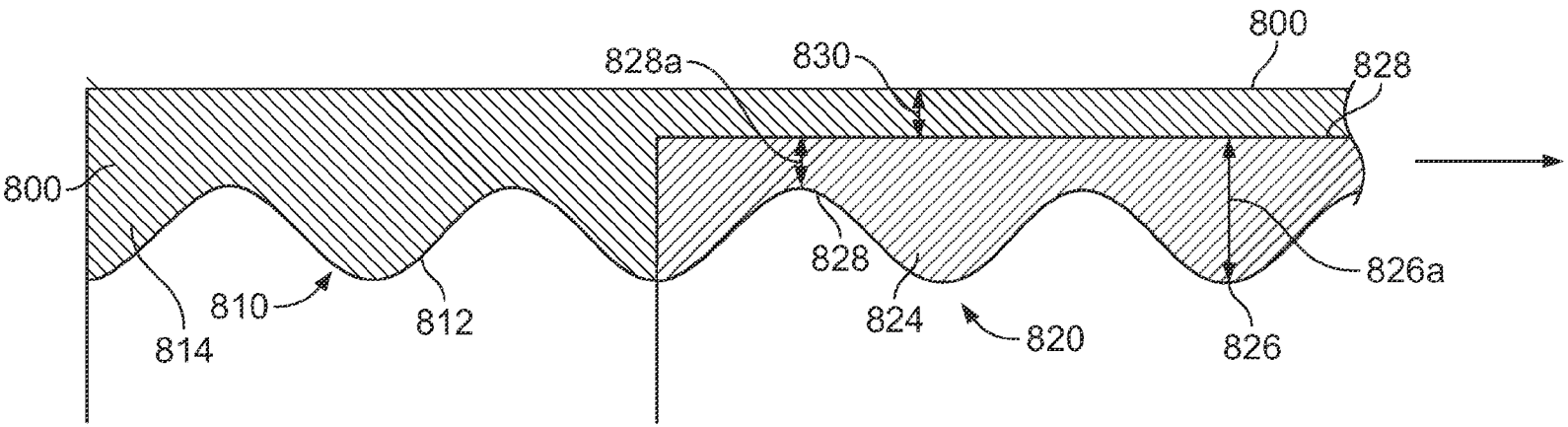
FIG. 8 shows a stator whose middle section includes a non-uniform layer of a sealing material.

FIG. 8 shows an end section 810 and a partial middle section 820 of a stator 800. The inner lobed surface 812 of the end section 810 is made of or lined with a metallic material 814. The outer lobes 822 of the middle lobed-section 820 of the stator 800 are made of or lined with an elastomeric material 824. The thickness of the elastomeric material 824 is uneven or not the same. For example, the thickness 826*a* of the ridge 826 is greater than the thickness 628*a* of the valley 628. The thickness 830 of the metallic backing or housing is the same for the elastomeric material 824. As clearly shown in FIG. 8, in certain embodiments, the elastomeric material 824 is at least partially embedded in the metallic material of the stator 800. Thus, in certain embodiments, the thickness of the metallic material embedded with the elastomeric material 824 of the middle section 820 differs from the metallic material of the end section 810. Although the exemplary embodiments of hybrid rotors and stators show a middle section with an elastomeric type material and one or both ends with metallic liners, other configurations, such as more than one continuous section of the rotor and/or motor may include metallic and or elastomeric material, so that at least a portion of the load on the sealing material is transferred to or shifted to a metallic or another material that is mechanically more resilient that the sealing material.

As briefly discussed before, using a continuous rubber lining on the stator (or on the rotor) has been proven to be satisfactory to various operating conditions because the rubber lining provides a reliable sealing between the rotor and stator to achieve good volumetric efficiency and high power output. However, the rubber lining also provides (radial) support for the rotor and is thus subjected to large loads (mostly pressure) acting on the rotor. The rubber lining, especially when used at high temperatures and/or used to generate increased power output (torque), hits its mechanical limits. A metal-metal power section, without any rubber, however, can withstand high temperatures and high loads, but exhibits lower volumetric efficiency than the power sections with a rubber lining, because the contact areas for the metal-metal sections between the rotor and stator lobes are substantially smaller compared to the contact areas for the rubber-lined rotor-stator sections. The disclosure herein provides progressive cavity motors and pumps with at least partial functional separation between the seal and load requirements that provides good sealing capacity on the one hand and good support for the rotor on the other hand. Instead of using a continuous rubber lining, parts of the power section form a metal-metal contact basically with the same contour geometry as the rubber lined sections. In this case, the metal-metal sections act like gears to support the rotor and take most of the loads, whereas the rubber sections provide the sealing capacity. By changing the fit between rotor and stator in the rubber-lined section, the sealing capacity and the load on the rubber can be adjusted as desired. As an alternative, the rubber-lined sections may be produced with a high press fit so that loads above a selected level (which may be relatively high) utilize metal-metal sections. Because varying contours can more easily be manufactured on the rotor outer surface compared to the inner stator surface, it is relatively easy to form the middle section of the rotor with a rubber liner, such as shown in FIGS. 3, 5 and 6. In certain operations, other configurations may be more beneficial that as shown in FIGS. 3-5, such as three or more metal-metal sections, for example. Also, the choice of materials is not restricted to metal and rubber. Other suitable materials that provide desired load distribution and sealing properties may be utilized.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. An apparatus for use in a wellbore, comprising:

a stator having an inner lobed-surface;

a rotor having an outer lobed-surface and disposed within the stator, wherein at least one of the inner lobed-surface of the stator and the outer-lobed surface of the rotor includes: a sealing material on a first contacting section at least partially embedded in a metallic material of the respective at least one of the inner lobed-surface of the stator and the outer-lobed surface of the rotor thereof and a metallic surface on a second contacting section of the respective at least one of the inner lobed-surface of the stator and the outer-lobed surface of the rotor thereof.

2. The apparatus of claim 1, wherein the first section is a middle section and the second section is an end section.

3. The apparatus of claim 1, wherein the sealing material is substantially uniform in thickness.

4. The apparatus of claim 1, wherein the sealing material is uneven in thickness.

5. The apparatus of claim 1, wherein the inner lobed surface includes a first plurality of lobed stages and the outer lobed surface includes a second plurality of lobed stages and wherein the sealing material occupies at least one stage of the one of the inner lobed surface and the outer lobed surface.

6. The apparatus of claim 1, wherein the metallic surface is dimensioned to reduce mechanical load on the sealing surface by a preselected amount.

7. The apparatus of claim 1, wherein the first section forms a positive interference fit between the inner lobed-surface and the outer lobed-surface and the second section forms a zero or negative interference fit between the inner lobed surface and the outer lobed-surface.

8. The apparatus of claim 1, wherein the apparatus is configured to operate as a mud motor or pump.

9. An apparatus for use in a wellbore, comprising:

a bottomhole assembly having at least one sensor for determining a parameter of interest;

a drilling motor configured to rotate a drill bit attached to an end of the bottomhole assembly, wherein the drilling motor includes a stator having an inner lobed-surface and a rotor having an outer lobed-surface and disposed within the stator and wherein at least one of the inner lobed-surface of the stator and the outer-lobed surface of the rotor includes; a sealing material on a first contacting section at least partially embedded in a metallic material of the respective at least one of the inner lobed-surface of the stator and the outer-lobed surface of the rotor thereof and a metallic surface on a second contacting section of the respective at least one of the inner lobed-surface of the stator and the outer-lobed surface of the rotor thereof.

10. The apparatus of claim 9, wherein the first section is a middle section and the second section is an end section.

11. The apparatus of claim 9, wherein the sealing material is substantially uniform in thickness.

12. The apparatus of claim 9, wherein the sealing material is uneven in thickness.

13. The apparatus of claim 9, wherein the inner lobed surface includes a first plurality of lobed stages and the outer lobed surface includes a second plurality of lobed stages and wherein the sealing material occupies at least one stage of the one of the inner lobed surface and the outer lobed surface.

14. The apparatus of claim 9, wherein the metallic surface is dimensioned to reduce mechanical load on the sealing surface by a preselected amount.

15. The apparatus of claim 9, wherein the first section forms a positive interference fit between the inner lobed-surface and the outer lobed-surface and the second section forms a zero or negative interference fit between the inner lobed surface and the outer lobed-surface.

16. The apparatus of claim 9 further comprising a drill bit coupled to the drilling motor.

17. The apparatus of claim 9 further comprising a plurality of force application members configured to apply force on wellbore during a drilling operation.

18. A method of drilling a wellbore, comprising:

deploying a drill string in the wellbore that includes a drilling motor coupled to a drill bit at an end of the drill string, wherein the drilling motor includes a stator having an inner lobed-surface, a rotor having an outer lobed-surface and disposed within the stator, wherein at least one of the inner lobed-surface of the stator and the outer-lobed surface of the rotor includes: a sealing material on a first contacting section at least partially embedded in a metallic material of the respective at least one of the inner lobed-surface of the stator and the outer-lobed surface of the rotor thereof and a metallic surface on a second contacting section of the respective at least one of the inner lobed-surface of the stator and the outer-lobed surface of the rotor thereof; and supplying a fluid under pressure to the drilling motor to rotate the rotor and the drill bit to drill the wellbore.

19. The method of claim 18, wherein the drill sting further includes a steering device configured to steer the drill bit in a selected direction and wherein the method further comprises steering the drill bit by the steering device to drill the wellbore along a selected path.

20. The method of claim 18, wherein the drilling assembly further incudes a sensor configured to provide measurements relating to a downhole parameter of interest and wherein the method further comprises for determining the parameter of interest using the measurements from the sensor during drilling of the wellbore.

21. A progressive cavity device, comprising:

a stator having an inner lobed-surface; and a rotor having an outer lobed-surface and disposed within the stator, wherein at least one of the inner lobed-surface of the stator and the outer-lobed surface of the rotor includes: a non-metallic sealing material on a first contacting section at least partially embedded in a metallic material of the respective at least one of the inner lobed-surface of the stator and the outer-lobed surface of the rotor thereof and a metallic surface on a second contacting section of the respective at least one of the inner lobed-surface of the stator and the outer-lobed of the rotor thereof.

22. An apparatus for use in a wellbore, comprising:

a string deployed in the wellbore configured to produce a fluid from the wellbore; and a progressive cavity device placed in the string configured to pump the fluid from the wellbore to the surface, wherein the progressive cavity device includes a stator having an inner lobed-surface and a rotor having an outer lobed-surface disposed within the stator and wherein at least one of the inner lobed-surface of the stator and the outer-lobed surface of the rotor includes: a sealing material on a first contacting section at least partially embedded in a metallic material of the respective at least one of the inner lobed-surface of the stator and the outer-lobed surface of the rotor includes a sealing material on a first contacting section of the respective at least one of the inner lobed-surface of the stator and the outer-lobed surface of the rotor thereof and a metallic surface on a second contacting section of the respective at least one of the inner lobed-surface of the stator and the outer-lobed surface of the rotor thereof.

* * * * *